US012280909B2

(12) United States Patent
Simmons

(10) Patent No.: US 12,280,909 B2
(45) Date of Patent: Apr. 22, 2025

(54) CONTAINER AND METHOD AND APPARATUS FOR ADDING A PRODUCT TO A CONTAINER

(71) Applicant: COLIN MEAR ENGINEERING LIMITED, Chard (GB)

(72) Inventor: Paul Simmons, Chard (GB)

(73) Assignee: COLIN MEAR ENGINEERING LIMITED, Chard (GB)

( * ) Notice: Subject to any disclaimer, the term of this patent is extended or adjusted under 35 U.S.C. 154(b) by 0 days.

(21) Appl. No.: 17/769,138

(22) PCT Filed: Jul. 28, 2020

(86) PCT No.: PCT/GB2020/051807
§ 371 (c)(1),
(2) Date: Apr. 14, 2022

(87) PCT Pub. No.: WO2021/074559
PCT Pub. Date: Apr. 22, 2021

(65) Prior Publication Data

US 2024/0109677 A1 Apr. 4, 2024

(30) Foreign Application Priority Data

Oct. 16, 2019 (GB) ..... 1914936

(51) Int. Cl.
*B65B 7/28* (2006.01)
*B65B 1/06* (2006.01)
(Continued)

(52) U.S. Cl.
CPC ..... *B65B 7/2878* (2013.01); *B65B 1/06* (2013.01); *B65B 43/40* (2013.01); *B65D 51/20* (2013.01);
(Continued)

(58) Field of Classification Search
CPC ..... B65B 7/2878; B65B 1/06; B65B 43/40; B65B 7/168; B65B 63/08; B65B 3/003;
(Continued)

(56) References Cited

U.S. PATENT DOCUMENTS 6,230,472 B1 5/2001 Stahlecker
6,637,176 B1 * 10/2003 Krall ..... B65D 41/20 53/471
(Continued)

FOREIGN PATENT DOCUMENTS

DE 4414756 A1 11/1995
FR 2565942 A1 12/1985
(Continued)

OTHER PUBLICATIONS

ISA/EPO, PCT/GB2020/051807, PCT Search Report mailed Oct. 8, 2020, Niels Jervelund (4 pgs).
(Continued)

*Primary Examiner* — James N Smalley
(74) *Attorney, Agent, or Firm* — Crawford Maunu PLLC

(57) ABSTRACT

The invention relates to a container (100) having an aperture (140) and a seal assembly (200), comprising a support member or disc (210) and a seal such as an induction seal (240). The support disc (210) has projections or cam surfaces (230) which engage with projections or cams (160) provided on the internal surface of the neck (120). The container is configured to have an intermediate configuration prior to containing a product, in which the container aperture is temporarily closed by the seal assembly (200). In this configuration, the internal cleanliness of the container is preserved. The seal assembly can be removed to add the product, and afterwards, the seal is made more permanent by applying induction energy to the seal and the container adopts a filled configuration containing the product in which
(Continued)

the container aperture is sealed. In this configuration, the container may be sealed by the seal assembly (200) (i.e. the support member (210) and the seal (240) or by the seal (240) alone, the support member having been removed during the sealing process.

16 Claims, 13 Drawing Sheets

(51) Int. Cl.

| | |
|---|---|
| ***B65B 7/16*** | (2006.01) |
| ***B65B 43/40*** | (2006.01) |
| ***B65B 63/08*** | (2006.01) |
| ***B65D 51/20*** | (2006.01) |
| ***B65D 53/04*** | (2006.01) |

(52) U.S. Cl.
CPC ..... *B65D 53/04* (2013.01); *B65B 7/168* (2013.01); *B65B 63/08* (2013.01)

(58) Field of Classification Search
CPC ..... B65B 3/06; B65B 7/2835; B65B 51/227; B65D 51/20; B65D 53/04; B65D 2251/0093; B65D 43/0229; B65D 2251/0012; B65D 2251/0018; B67B 3/20; B67B 7/182; B67C 7/0073; A61J 1/03
See application file for complete search history.

(56) References Cited

U.S. PATENT DOCUMENTS

| | | | | |
|---|---|---|---|---|
| 7,648,764 | B2 * | 1/2010 | Yousif | B32B 7/06 428/35.8 |
| 7,798,359 | B1 | 9/2010 | Marsella | |
| 7,832,580 | B2 * | 11/2010 | Jackman | B65D 51/20 215/349 |
| 8,910,811 | B2 * | 12/2014 | Parrinello | B65D 11/04 215/350 |
| 10,625,894 | B2 * | 4/2020 | Boira Bonhora | B65B 3/003 |
| 2006/0070997 | A1 * | 4/2006 | Sjoholm | B65D 51/002 220/254.1 |
| 2016/0207255 | A1 | 7/2016 | Chang | |

FOREIGN PATENT DOCUMENTS

| | | | |
|---|---|---|---|
| GB | 1228203 | A | 4/1971 |
| GB | 2417240 | A | 9/2007 |
| WO | 1993001098 | A2 | 1/1993 |
| WO | 2004074162 | A1 | 9/2004 |

OTHER PUBLICATIONS

CSER/EPO, GB1914936.8, Combined Search and Examination Report, mailed Feb. 26, 2020, Henry You (6 pgs).

* cited by examiner

CONTAINER AND METHOD AND APPARATUS FOR ADDING A PRODUCT TO A CONTAINER

TECHNICAL FIELD

The invention relates to a container for containing a product, and also to a method and an apparatus for adding a product to a container. In particular, the invention relates at least in preferred embodiments to a container which is closed or sealed in an internally-clean condition and free from contamination prior to adding the product to the container. The method and apparatus for adding the product to the container are intended to maintain the internally-clean condition and also to prevent the escape of any product to the external environment during filling.

The present invention, as will be understood from the description below, has particular application in the pharmaceutical field, but the container, method and apparatus will be suitable for use in a wide variety of other areas, where it is desirable to maintain a level of cleanliness in the container before filling, and/or where it is desirable to prevent escape of the product into the environment during filling. Product areas include pharmaceuticals, chemicals, food ingredients or products, hazardous chemicals, reagents and the like.

BACKGROUND ART

Known containers, filling methods and filling apparatus in this field are generally complex and relatively expensive. For example, existing containers in some systems are designed for multiple use and not intended to go to the end user of the product (typically an individual consumer) due to size, cost, complexity, and requirements for specialist equipment to open.

The invention, at least in preferred embodiments, is designed to simplify and reduce the cost of the filling process while maintaining at least an acceptable level of containment and cleanliness, and to provide a container which is designed to reach the consumer.

SUMMARY OF THE INVENTION

In accordance with a first aspect, the present invention provides a container for containing a product, comprising a container body having an aperture and a seal assembly, the seal assembly comprising a seal and a seal support member, wherein the container is configured to have an intermediate configuration prior to containing the product in which the container aperture is closed by the seal assembly, and wherein the container is configured to have a filled configuration containing the product in which the container aperture is sealed.

The term "filled configuration" is intended to refer to a configuration in which any specified or required amount of product is present in the internal volume of the container such that the container can be (re-)sealed. It is not intended to require that the internal volume is full.

In the filled configuration, as will be discussed further below, the sealing function may be performed by the seal alone (whether or not the seal support member is still present), or the sealing function may be performed by a combination of the seal and the seal support member.

In the intermediate configuration, the container is closed by the seal assembly. The aperture may be covered, blocked or obstructed by the seal assembly which is held in place by suitable means, or a level of sealing (e.g. a temporary bond) may be provided. In this configuration, the container is effectively "temporarily" closed or sealed by the seal assembly. In the filled configuration, the seal is preferably some form of a bond and is more "permanent" in nature, although of course intended to be breakable by the end consumer to access the contents.

Preferably, a shoulder is provided on the container body around the periphery of the aperture, the seal contacting the shoulder in both configurations. The container may have a neck which defines or delimits the aperture, and the shoulder can be provided on the internal surface of the neck. In the filled configuration, the seal preferably has a sealing engagement with the shoulder.

In a preferred arrangement, the seal is held in place by the seal support member in the intermediate configuration to close the aperture. In addition to physically holding the seal in place to close the aperture, the seal support member may also provide support to the seal so that it is supported or held in place across the aperture.

The seal support member is preferably configured to be movable (e.g. rotatable) into an interference fit with the container body (such as the internal surface/periphery of the aperture) to hold the seal in place in the intermediate configuration. In this arrangement, the seal support member may be provided with projections (such as radially-extending projections) which, when the seal support member is rotated, engage with corresponding surfaces provided on the container body to provide the interference fit. The surfaces may be provided on the internal surface/periphery of the aperture and may project inwardly from the internal periphery of the aperture, so that they effectively reduce the size/diameter of aperture. When the container body is provided with a shoulder as discussed above, these surfaces may be provided adjacent to the shoulder, e.g. outboard/outermost relative to the interior volume of the container.

The seal and seal support member may take any suitable physical form to perform their function. Their shape and form will be determined in part or in whole by the shape of the container aperture. If the aperture is circular, the seal and/or the seal support member may also have circular peripheries, and they may further be discs. The seal and the seal support member may be substantially coterminous or substantially coextensive.

In preferred embodiments, the seal may be internal or external to the seal support member relative to the interior of the container in the intermediate configuration and, if the support member is present, also in the filled configuration.

The seal may be coextensive with the aperture or have a larger area than the aperture, so that it covers the full area of the aperture and is able to close and seal it. In the filled configuration, the seal support member may or may not be present, but the sealing function is provided by the seal alone.

In an alternative preferred form, the container aperture is substantially circular and the seal is an annulus, the aperture being closed in the intermediate configuration and sealed in the filled configuration by the seal and the seal support member in combination. In this embodiment, the seal support member is of course present in the filled configuration.

In the filled configuration, the container aperture may be sealed by the seal assembly. In this embodiment, both the seal and the seal support member are present. Both components may provide the sealing function in combination (e.g. as in the annular seal configuration mentioned above), or alternatively while the seal support member is present, the sealing function is provided by the seal alone (e.g. when the seal is coextensive with the aperture or has a larger area than the aperture, as mentioned above).

The container may be made from any suitable material, including plastics, glass or metal. Preferably, the container is made from a polymeric material, and a particularly preferred material is HDPE. Preferably, the container body is provided with a hollow neck having a screw thread for a cap. The aperture is preferably defined by/within the neck, and the screw thread is provided on the external surface of the neck. Once the container is in the filled configuration with the aperture sealed, a cap (e.g. a child-proof cap) can be screwed onto the neck, over the sealed aperture, and the container can be processed further or shipped. Therefore, in a preferred embodiment, the container further includes a cap.

The seal support member may be made from any suitable material to perform its function. The component should have sufficient rigidity to support the seal in the intermediate configuration, and hold the seal in place if it is performing that function. Preferably, the seal support member is made from a polymeric material, and a particularly preferred material is HDPE.

The seal may be made from any suitable material to perform its function. The seal may be formed from a relatively thin, flexible substrate such as a polymeric layer or film. The seal may also be provided with a material which is designed to form the seal with the container, such as an adhesive layer or a layer which is designed to melt on application of energy to the seal. In a preferred embodiment discussed further below, the seal is an induction seal. Typical induction seals include a metal layer (e.g. aluminium foil) and a layer of polymer which is designed to melt when electromagnetic energy is applied to the seal, to create the seal with the container. A preferred form of seal is the TOP TAB™ induction seal available from Selig Sealing Products.

In the filled configuration, as will be discussed further below, the sealing function may be performed by the seal alone (whether or not the seal support member is still present), or the sealing function may be performed by a combination of the seal and the seal support member.

As mentioned above, in one preferred embodiment, the container aperture is sealed in the filled configuration by the seal alone, without the seal support member present. In this embodiment, the seal support member and seal are preferably attached by means of a bond (such as an adhesive bond) in the intermediate configuration. The bond is breakable to allow separation of the seal support member and seal to adopt the filled configuration. Preferably, the bond (e.g. the adhesive bond) is breakable by heating. The adhesive bond may be formed by a wax or wax-containing material.

Preferably, the container aperture is sealed in the filled configuration by heating the seal. The seal is preferably an induction seal (including a metal/foil layer) and the container aperture is sealed in the filled configuration by applying electromagnetic energy to heat the seal. In a particularly preferred embodiment, the heating of the seal simultaneously heats the bond holding the seal support member and seal together, to permit separation. The single heating operation has two effects: to create the "permanent" seal and to release the seal support member from the seal.

In an alternative arrangement, where the seal is held in place by the seal support member in the intermediate configuration (e.g. by the interference fit mentioned above), the seal and the seal support member may not be attached together, but could instead be held together during removal of the seal assembly, filling of the container, and replacement of the seal assembly, by means of a vacuum. The vacuum may be the same vacuum used by the seal assembly handling means to manipulate the seal assembly, discussed further below.

In accordance with a second aspect, the present invention provides a method of adding a product to a container as described above, comprising the steps of: providing the container in the intermediate configuration, in which the container aperture is closed by the seal assembly; removing the seal assembly to open the container; adding the product to the interior of the container; replacing the seal assembly; and applying energy to create a seal between the seal and the container so that the container adopts the filled configuration.

In one preferred method, the step of applying energy also creates a seal between the seal and the seal support member so that the container adopts the filled configuration sealed by the seal assembly.

An alternative preferred method further comprises the step of separating the seal support member from the seal so that the container adopts the filled configuration sealed by the seal alone without the seal support member present.

In this alternative preferred method, the seal support member and seal are preferably attached by means of a bond (e.g. an adhesive bond) in the intermediate configuration, the bond being breakable, such as by heating, to allow separation of the seal support member and seal to adopt the filled configuration. Therefore, the step of applying energy preferably comprises heating the seal. As described further, heating the seal preferably simultaneously heats the bond holding the seal support member and seal together to permit separation. When the seal is an induction seal, the step of applying energy comprises applying electromagnetic energy to heat the seal.

In accordance with a third aspect, the present invention provides apparatus for adding a product to a container as described above, comprising: a filling chamber into which at least a part of the container in the closed intermediate configuration is inserted; seal assembly handling means which is configured to attach to and separate the seal assembly from the container to open the container, and which is further configured to replace the seal assembly on the container after addition of the product to the container; supply means configured to supply the product to the interior of the container; and means for applying energy configured to create a seal between the seal and the container so that the container adopts the filled configuration.

The seal assembly handling means may comprise any suitable mechanism or structure for handling or manipulating the seal assembly and/or the seal support member after separation.

Preferably, the seal assembly handling means is a piston which attaches to the seal assembly (e.g. the seal support member) by means of a vacuum generated between the piston and the seal assembly. The skilled person will understand that "vacuum" simply means a pressure of less than the ambient pressure in the apparatus, which will typically be atmospheric pressure. As mentioned above, this vacuum may also serve to keep the seal in contact with the seal support member.

An alternative seal assembly handling means may comprise a piston provided with engaging means configured to mechanically engage with a corresponding feature on the seal assembly (e.g. on the seal support member). A feature may be provided on the seal support member for this purpose.

As discussed above, the seal support member is preferably configured to be movable (e.g. rotatable) into an interference fit with the container body (such as the internal surface/periphery of the aperture) to hold the seal in place in the intermediate configuration. Preferably therefore, the seal assembly handling means is configured to move (e.g. rotate) the seal support member out of the interference fit position and separate the seal assembly from the container. The engaging means mentioned above may be suitable to achieve rotation, e.g. in the form of pins, in addition to handling or manipulating the seal assembly.

In one preferred apparatus, the means for applying energy is also configured to create a seal between the seal and the seal support member so that the container adopts the filled configuration sealed by the seal assembly.

In an alternative preferred apparatus, the seal assembly handling means is configured to separate the seal support member from the seal after the seal is created, so that the container adopts the filled configuration sealed by the seal alone without the seal support member present.

In this alternative preferred apparatus, the seal support member and seal are preferably attached by means of a bond (e.g. an adhesive bond) in the intermediate configuration, the bond being breakable, such as by heating, to allow separation of the seal support member and seal to adopt the filled configuration. Therefore, the means for applying energy to create a seal between the seal and the container preferably comprises means for heating the seal. As described further, the means for heating the seal simultaneously heats the bond holding the seal support member and seal together to permit separation. When the seal is an induction seal, the means for applying energy to create a seal between the seal and the container comprises means for applying electromagnetic energy to heat the seal.

In its various aspects and preferred embodiments, the present invention provides a container, method and apparatus which preserves the cleanliness of the internal volume of the container in a cost-effective manner.

In a preferred process, the container is first cleaned and then closed or sealed in the intermediate configuration as discussed above, in an internally-clean condition and free from contamination. The container can then be moved to an environment with reduced cleanliness if desired, but the internal volume remains closed and free from contamination due to the temporary seal, preferably created by the seal being held in place by the seal support member.

The filling operation is preferably carried out in a sealed, isolated and/or clean environment, to avoid contamination of the product and of the contamination-free internal volume of the container. It may also be desirable or necessary to minimise contamination of the external environment by the product being added to the container, for example if dust is created or if the product is a pharmaceutical or an otherwise potentially harmful substance.

The external surfaces of the container may not be free from contamination, e.g. if the closed container has moved through an environment of reduced cleanliness, and in a preferred operation, only the neck of the container is inserted into the filling apparatus to reduce the amount of the container external surface which is exposed in the apparatus. In a particularly preferred arrangement, only the seal assembly and a minimal amount of the aperture periphery are exposed in the apparatus.

During the filling operation, the seal assembly is removed by the seal assembly handling means. In a preferred embodiment, the seal assembly handling means is a piston and any contamination which is on the exterior surface of the seal assembly or on the surface of the piston is isolated and held between the piston and the seal support member during the filling operation. With the seal assembly removed from the container, the container can be filled in a clean environment.

As mentioned above, in one preferred embodiment, the container aperture is sealed in the filled configuration by the seal alone, without the seal support member present. In this embodiment, the seal support member and seal are preferably attached by means of a breakable bond (such as an adhesive bond) in the intermediate configuration. When the seal assembly is replaced on the container after filling, the piston remains in contact with the seal support member after separation of the seal support member from the seal. The now-exposed external surface of the seal is preferably clean and free from contamination, and therefore the external surfaces of the filled configuration container are generally clean. The container can then be moved out of the filling apparatus and, optionally, a cap can be placed on the container over the seal if desired. The seal support member can then be discarded. Even though the part of the seal assembly handling means/piston which contacts the seal support member may not be clean, the seal support member of the next container to be filled will "lock-in" and isolate any contamination when they are engaged with one another.

In any aspect of the invention discussed above, it is envisaged that more than one product can be added to a container, either simultaneously in a single filling operation, or in sequential filling operations. The seal assembly may be replaced between filling operations, effectively in a "temporary" seal configuration, so that the container can pass from a first filling apparatus, via a non-clean environment if applicable, to a second filling apparatus, where the seal assembly is separated again. The claimed invention specifically relates to the final operation in the sequence, where a product is added to the container for the final time and the container is sealed with the seal alone and not the seal support member, effectively in a more "permanent" manner.

BRIEF DESCRIPTION OF THE DRAWINGS AND DETAILED DESCRIPTION OF A PREFERRED EMBODIMENT

An embodiment of the invention will now be described by way of example only and with reference to the accompanying drawings, in which.

Figure 1A:
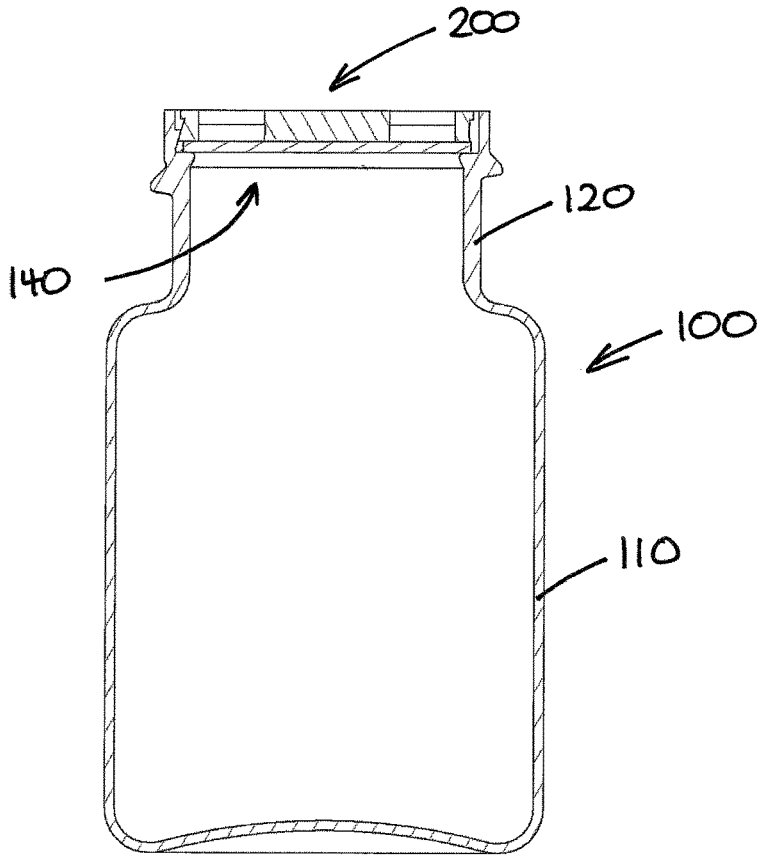
FIGS. 1-3 show a container and filling apparatus in accordance with the invention in which the container is fitted with a seal assembly, prior to filling
(FIG. 1B is an enlargement of FIG. 1A)
Figure 1B:
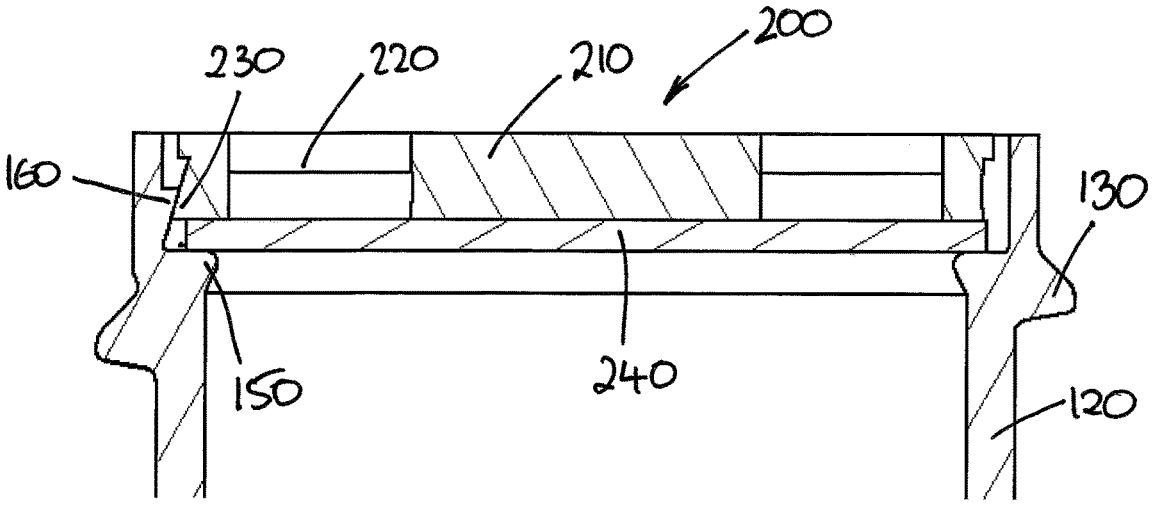
Figure 2:
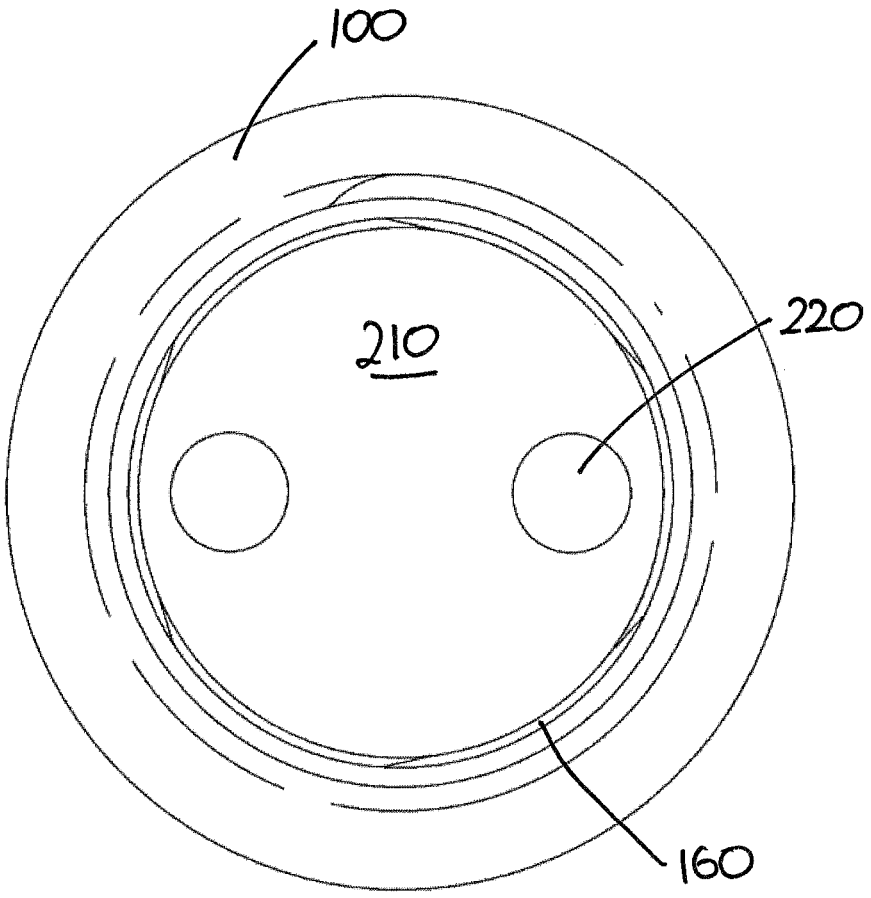
Figure 3:
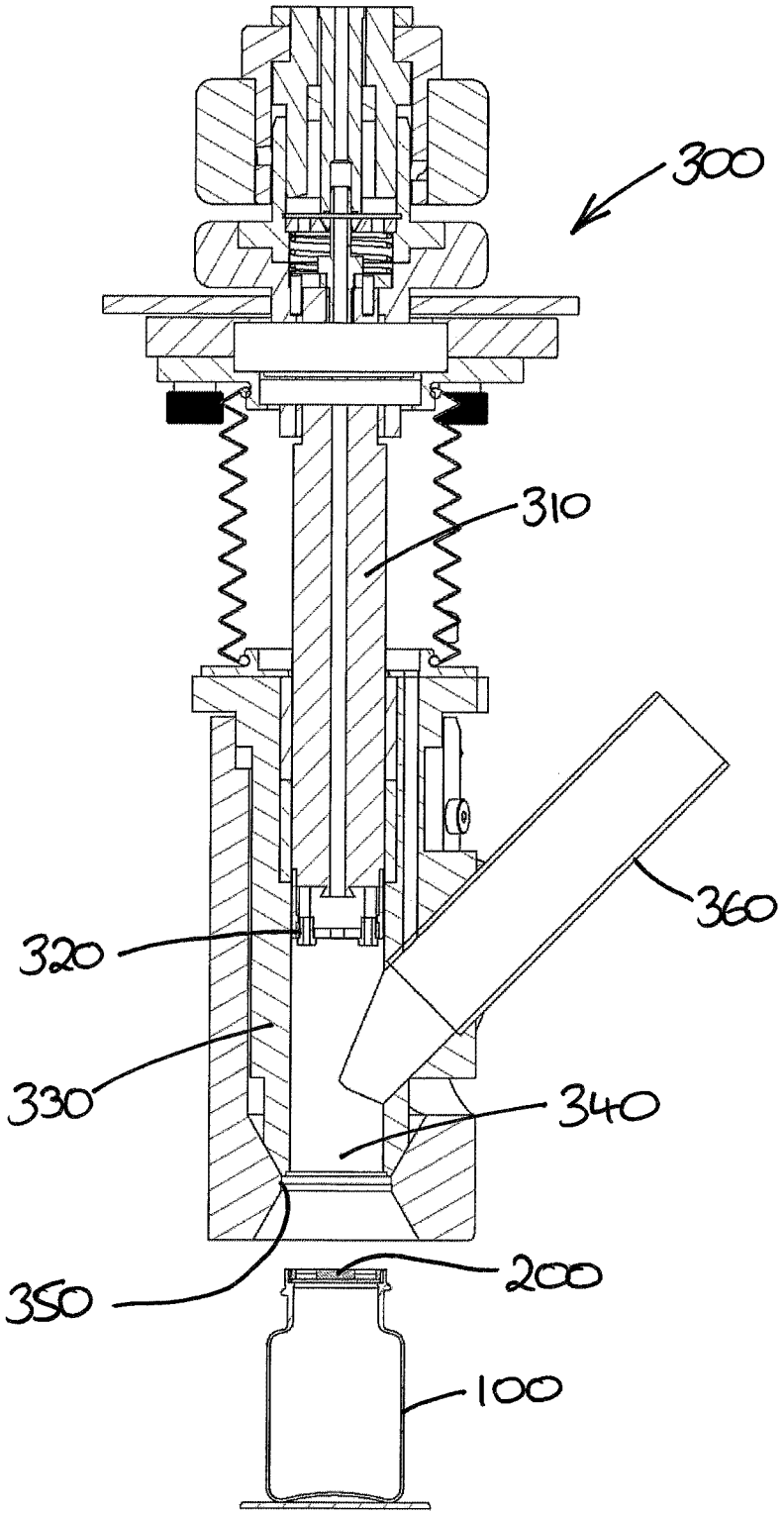

Referring to FIGS. 1-3, a container 100, seal assembly 200 and filling apparatus 300 are shown in which the container is fitted with a seal assembly, prior to filling. Container 100 is shown, in the form of a bottle typically used for containing a product such as a pharmaceutical. Container 100 has a generally cylindrical body 110 closed at the base. The container has a neck 120 with an external screw thread 130. Internally, the neck defines an aperture 140 for filling and removing the product. The internal surface of the neck 120 is provided with a lip 150 for seating and sealing with the seal, and a plurality of projections or cams 160 which cooperate with cams on the support disc as described below.

Seal assembly 200 comprises a support member in the form of a support disc 210 which has a plurality of apertures or recesses 220 for receiving pins during handling and rotation. Support disc 210 also has a plurality of projections or cams 230 which cooperate with the projections/cams 160 on the container (see FIG. 1B; cams 230 are not visible in FIG. 2).

Seal assembly 200 also comprises a seal 240 in the form of a foil induction seal. Such seals typically comprise a foil layer with a polymer coating on the underside which, when the foil is heated by induction, melts and forms a bond with the polymer of the container to create the seal. Above the foil layer, there is typically provided a backing layer such as paper and an adhesive such as wax which attaches the backing layer to the foil. The wax also melts when the foil is heated by induction, so the backing layer can be separated from the foil once the seal has been created.

The seal assembly is fitted to the container by placing the seal 240 in contact with the lip 150 and rotating the seal assembly relative to the container (e.g. by rotating the seal assembly or by rotating the container) so that the projections 230 on the support disc 210 engage with the projections 160 on the container. The seal 240 is not inductively sealed to the container however. In this configuration, the container is sufficiently securely closed by the seal assembly, which is locked in position, so that it can be transported, in an environment with reduced cleanliness if necessary, while preserving the contamination-free status of the interior space of the container.

FIG. 3 shows filling apparatus 300. The skilled person will be aware of the required technical features of a typical filling apparatus, and only the basic apparatus features as they relate to the invention will be described. Filling apparatus 300 comprises a piston 310 which is provided with pins 320 for cooperating with the apertures or recesses 220 on the support disc 210. The piston 310 and pins 320 are configured to hold and rotate the support disc 210. In addition to being rotatable by means of the piston 310, the pins 320 are supplied with a vacuum through bores 321 for holding the seal assembly. In an alternative embodiment, support disc 210 can be held in position by pins 320 and the container 100 rotated. Correct engagement of the pins 320 with the recesses 220 may be determined by sensing the relative vertical positions of the pins/piston or container 100.

The piston 310 moves relative to a sleeve 330 which defines a bore 340 for the piston to move in. An aperture 350 is provided at the end of the bore which is configured to seal with the top of the container neck 120 during the filling process. A product supply chute 360 is provided for supplying the product to the bore 340 and then into the container 100.

In FIG. 3, the container, closed by the seal assembly in a temporary but secure manner, is shown as having arrived at the filling apparatus and about to be engaged with the aperture 350 for filling.

Figure 4:
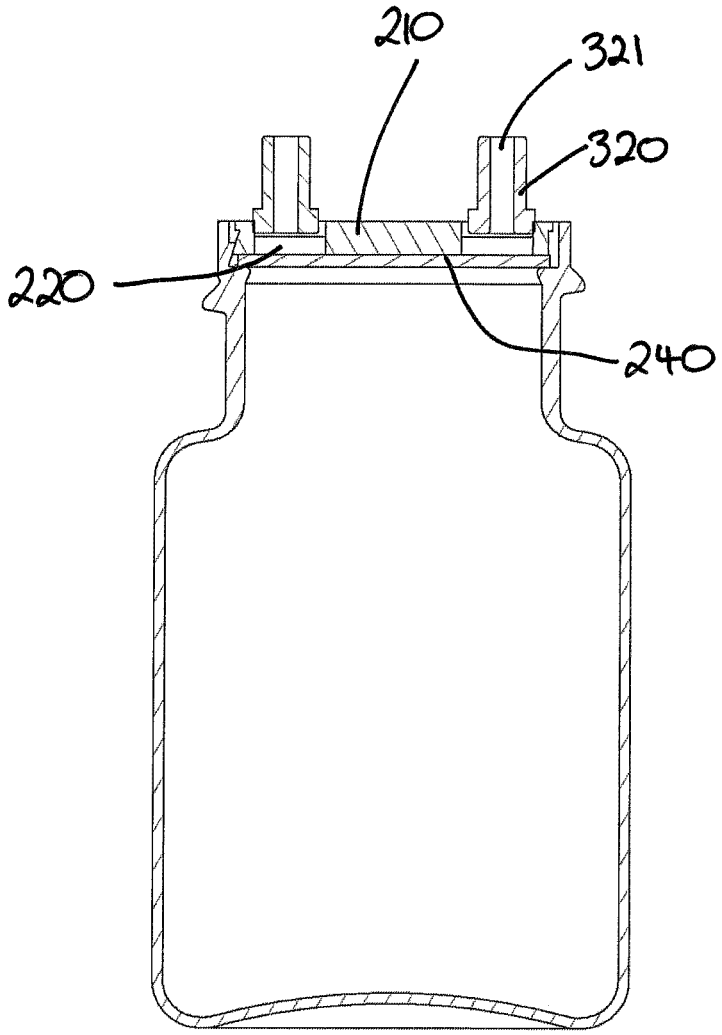
FIGS. 4 and 5 show the container and filling apparatus in which the container is being opened prior to filling.
Figure 5:
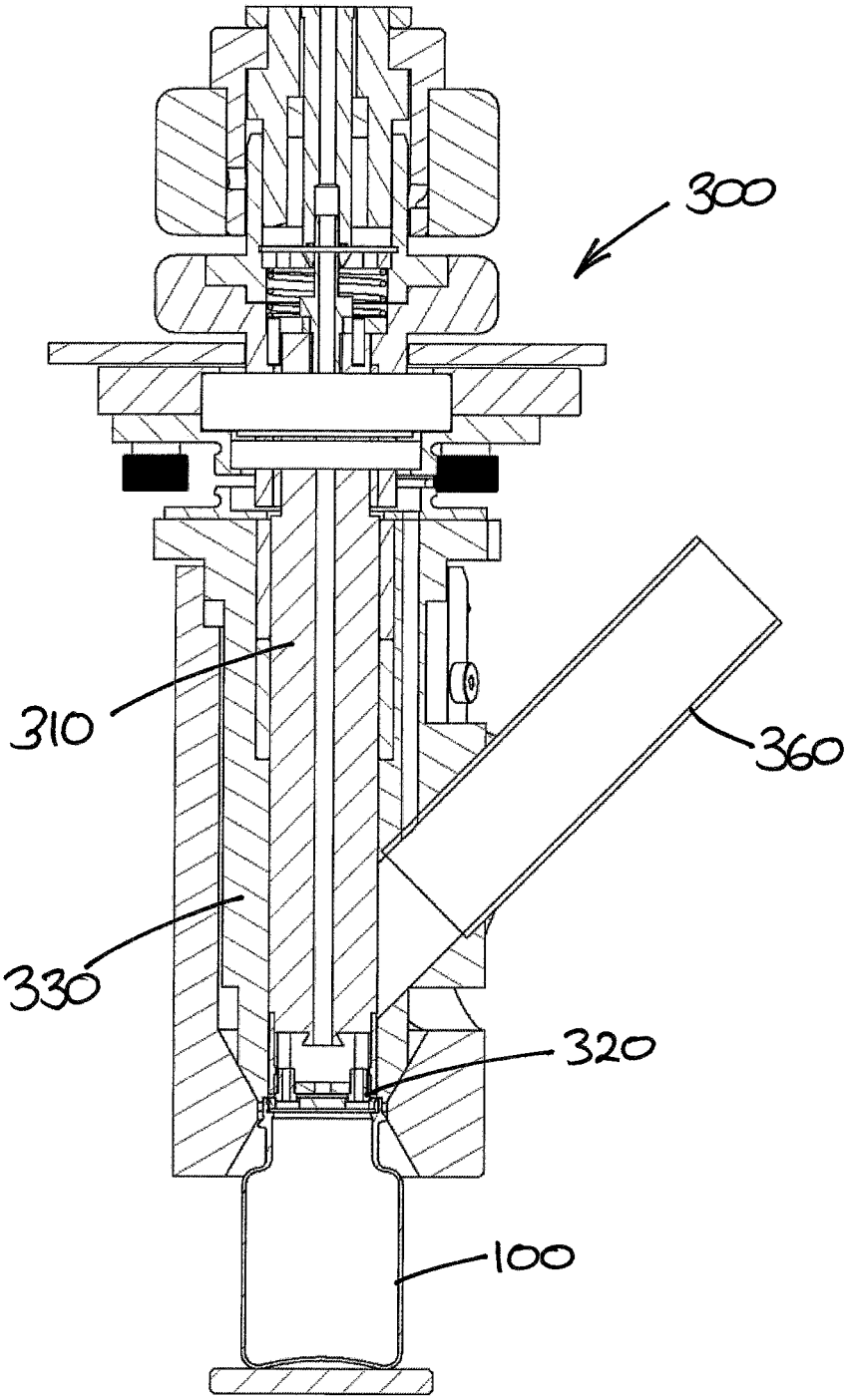

Turning to FIGS. 4 and 5, the next stage of the filling process is shown. Support disc 210 is engaged by pins 320 which rotate the disc relative to the container 100 to disengage the projections 160 and 230 from one another and permit the support disc 210 to be lifted away. In an alternative embodiment, support disc 210 can be held in position by pins 320 and the container 100 rotated.

Figure 6:
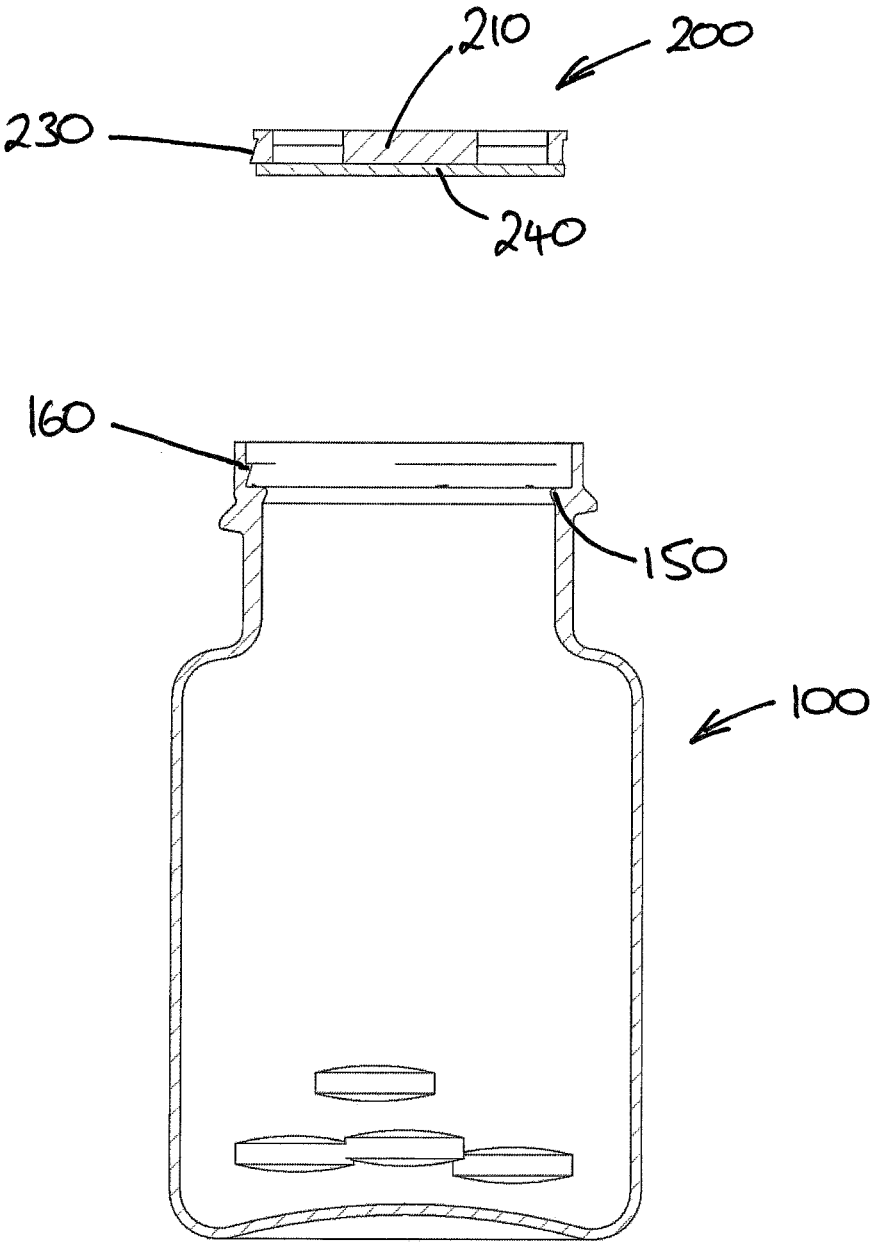
FIGS. 6 and 7 show the container and filling apparatus in which the seal assembly is separated from the container and the container is filled.
Figure 7:
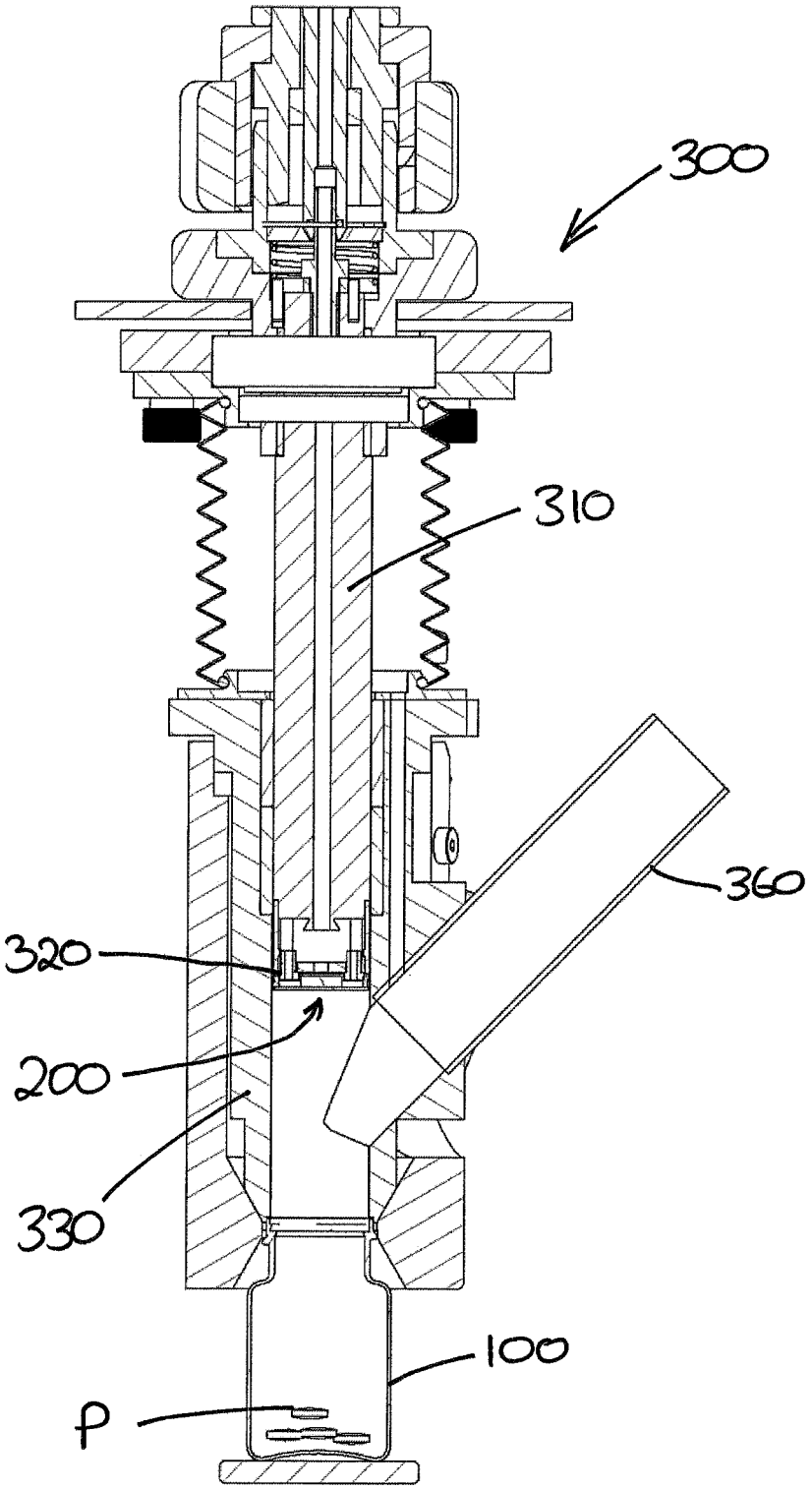

In FIGS. 6 and 7, the seal assembly 200 has been lifted away by the piston 310 by means of a vacuum supplied through the pins 320, and the container 100 is filled with product P via chute 360.

Figure 8:
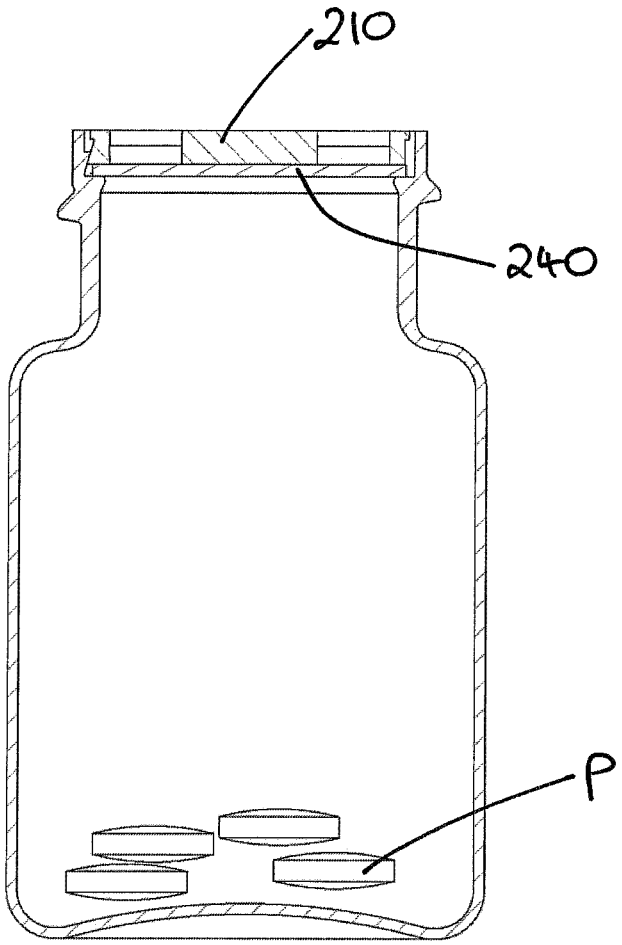
FIGS. 8 and 9 show the container and filling apparatus in which the seal assembly is replaced on the filled container.
Figure 9:
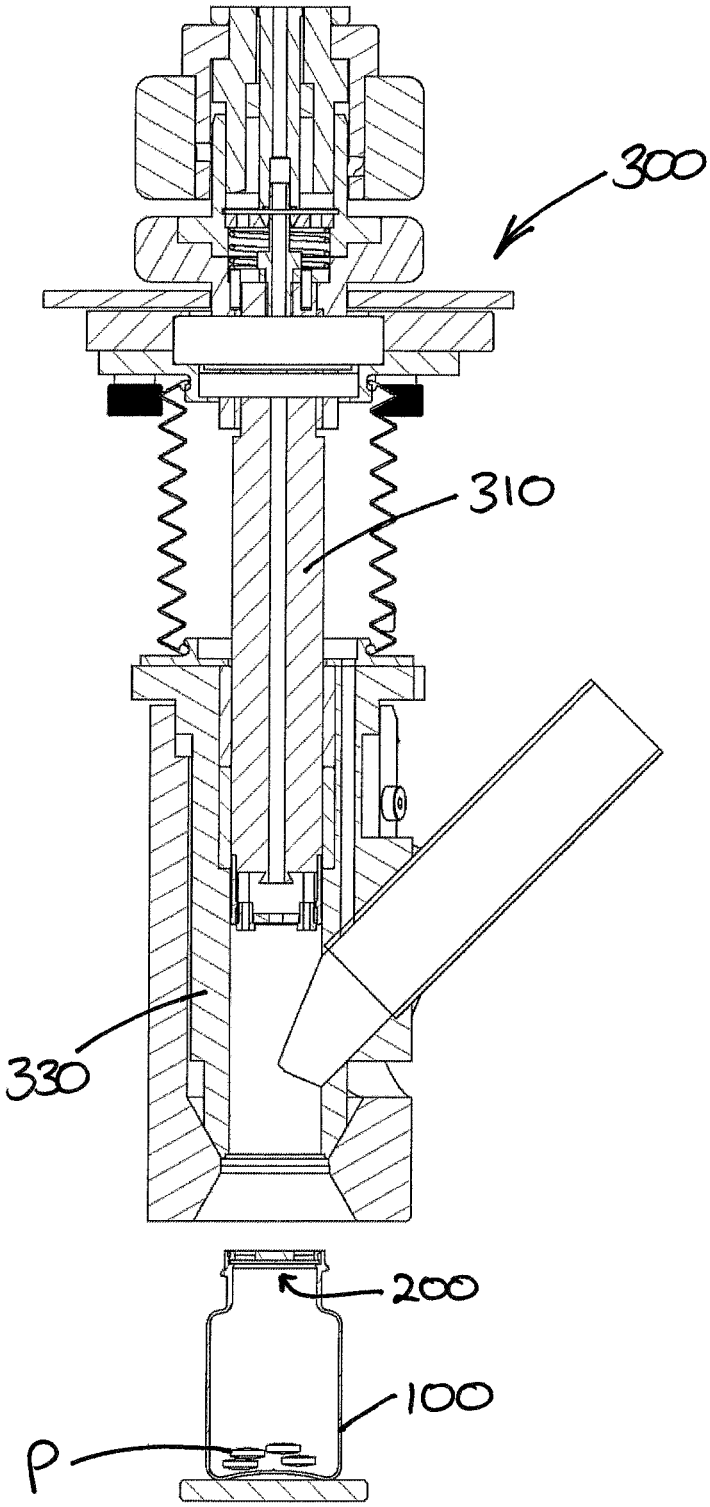

In FIGS. 8 and 9, the seal assembly 200 is shown having been replaced on the container and locked in position by rotating the seal assembly 200/support disc 210 (or by rotating container 100) to re-engage projections 160 and 230. In this configuration, it is possible to transport the filled container to another filling apparatus for additional product to be added if desired, in the same manner as described above.

Figure 10:
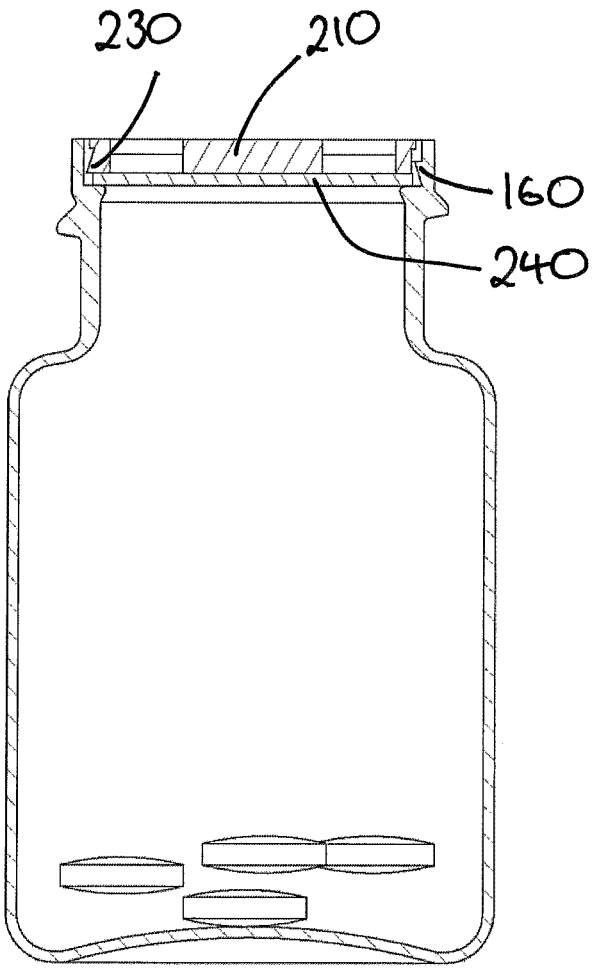
FIGS. 10 to 12 show the container and sealing apparatus in which the support member is unlocked and electromagnetic energy is applied to the seal assembly.
Figure 11:
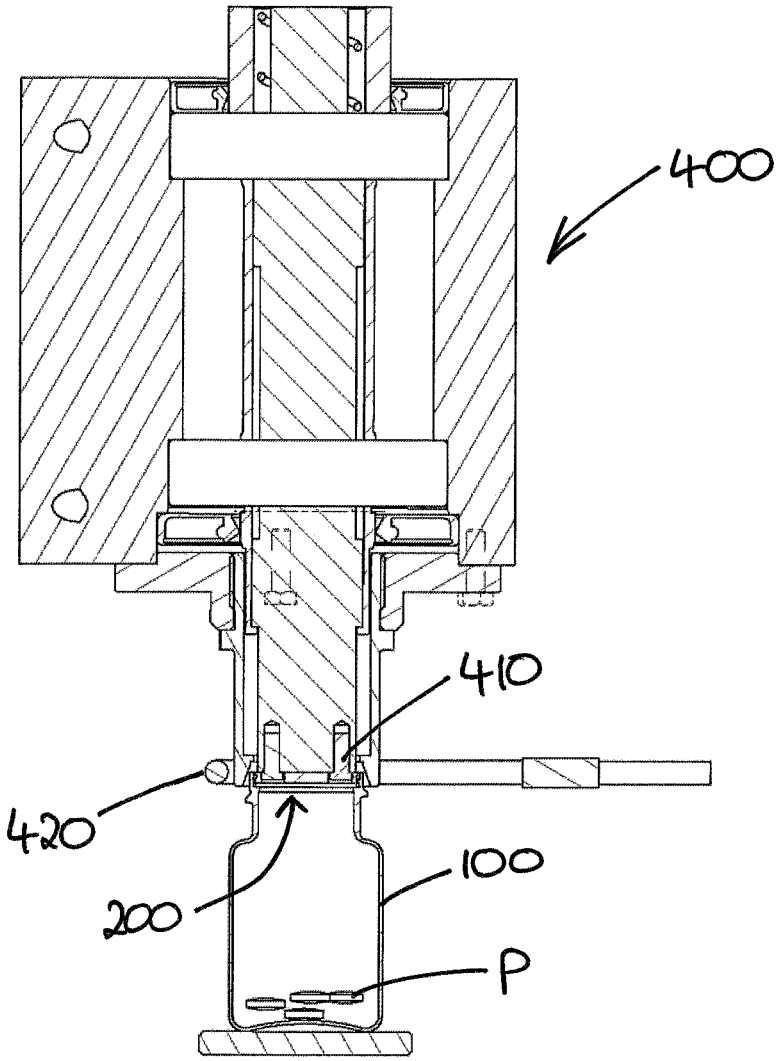
Figure 12:
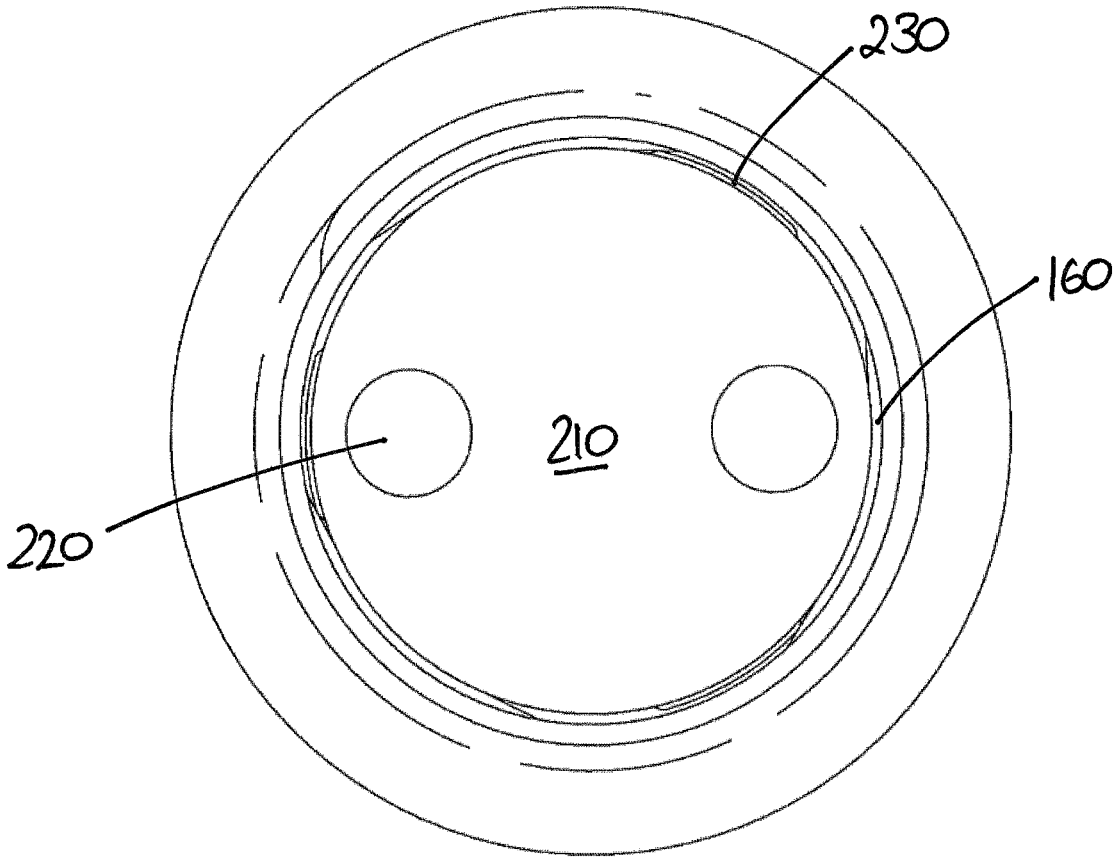

FIGS. 10 to 12 show the stage of applying electromagnetic energy to the induction seal to create a final, more permanent seal so that the container can be shipped to the consumer. FIG. 11 shows a sealing apparatus 400 which includes pins 410 to unlock the support disc by rotating it relative to the container and to apply pressure to the seal while an induction coil 420 applies electromagnetic energy to the foil layer. FIG. 12 shows the support disc in the unlocked position, with projections 160 and 230 visible.

Figure 13:
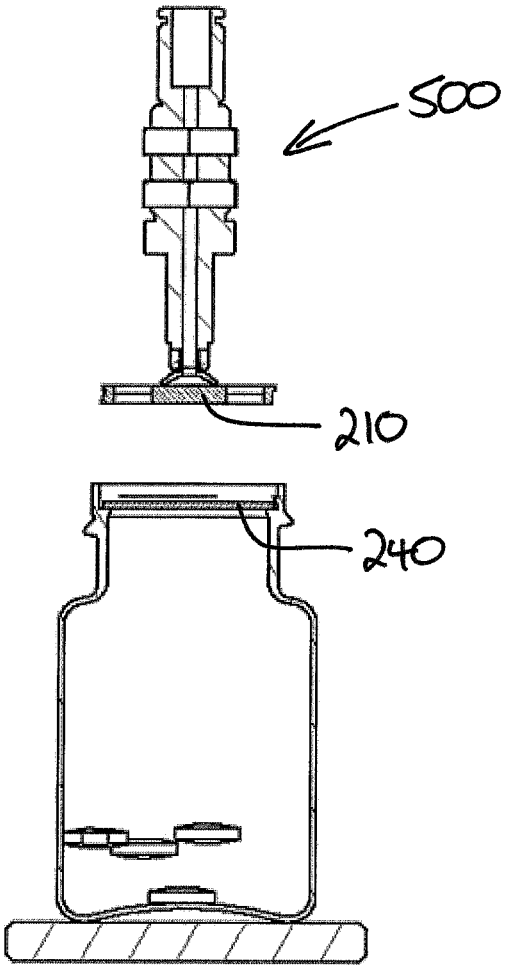
FIG. 13 shows the container and filling apparatus in which the support member is separated from the container leaving the seal in place on the container.

FIG. 13 shows the final stage of removing the support disc 210 and backing paper by means of disc removal apparatus 500, leaving the foil seal 240 sealed to the container neck.

The invention claimed is:

1. A container for containing a product, comprising a container body having an aperture and a seal assembly, the seal assembly comprising a seal and a seal support member, wherein the container is configured to have an intermediate configuration prior to containing the product in which the container aperture is closed by the seal assembly, the seal assembly being removable from the container to open the container aperture for filling with the product, wherein the container is configured to have a filled configuration containing the product in which the container aperture is sealed by the seal alone, without the seal support member present, wherein the seal support member and seal are attached by means of a bond in the intermediate configuration, the bond being breakable to allow separation of the seal support member and seal to adopt the filled configuration, wherein the seal support member is configured to be movable into an interference fit with the container body to hold the seal in place in the intermediate configuration, wherein the seal support member is provided with projections which, when the seal support member is rotated, engage with corresponding surfaces provided on the container body to provide the interference fit, and wherein the surfaces project inwardly from an internal periphery of the aperture.

2. The container of claim 1, wherein a shoulder is provided on the container body around the periphery of the aperture, the seal contacting the shoulder in both configurations.

3. The container of claim 2, wherein the surfaces are provided adjacent to the shoulder.

4. The container of claim 1, wherein the seal is held in place by the seal support member in the intermediate configuration.

5. The container of claim 1, wherein the seal support member is a disc.

6. The container of claim 1, wherein the seal and the seal support member are coterminous.

7. The container of claim 1, wherein the seal and the seal support member are coextensive.

8. The container of claim 1, wherein the seal is coextensive with the aperture or has a larger area than the area of the aperture.

9. The container of claim 1, wherein the container aperture is substantially circular and wherein the seal is a disc.

10. The container of claim 1, wherein the bond is breakable by heating.

11. The container of claim 1, wherein the container aperture is sealed in the filled configuration by heating the seal.

12. A container for containing a product, comprising a container body having an aperture and a seal assembly, the seal assembly comprising a heat activated seal and a seal support member, wherein the container is configured to have an intermediate configuration prior to containing the product in which the container aperture is closed by the seal assembly, the seal assembly being removable from the container to open the container aperture for filling with the product, wherein the container is configured to have a filled configuration containing the product in which the container aperture is sealed by the heat activated seal alone, without the seal support member present, wherein the seal support member and seal are attached by means of a bond in the intermediate configuration, the bond being breakable by heat to allow separation of the seal support member and seal to adopt the filled configuration, and wherein the heat activated seal and the heat breakable bond holding the seal support member and seal together are arranged for simultaneous heating to permit sealing and separation by a single heating operation.

13. The container of claim 12, wherein the seal support member is configured to be movable into an interference fit with the container body to hold the seal in place in the intermediate configuration.

14. The container of claim 13, wherein the seal support member is provided with projections which, when the seal support member is rotated, engage with corresponding surfaces provided on the container body to provide the interference fit.

15. The container of claim 12, wherein the seal is an induction seal and the container aperture is sealed in the filled configuration by applying electromagnetic energy to heat the seal.

16. The container of claim 12, wherein the container further includes a cap.

* * * * *